US006362107B1

(12) United States Patent
Shiro et al.

(10) Patent No.: US 6,362,107 B1
(45) Date of Patent: Mar. 26, 2002

(54) POLISHING PAD AND POLISHING DEVICE

(75) Inventors: Kuniyasu Shiro; Hisashi Minamiguchi; Tetsuo Oka, all of Shiga (JP)

(73) Assignee: Toray Industries, Inc., Tokyo (JP)

( * ) Notice: Subject to any disclaimer, the term of this patent is extended or adjusted under 35 U.S.C. 154(b) by 0 days.

(21) Appl. No.: 09/831,292

(22) PCT Filed: Nov. 5, 1999

(86) PCT No.: PCT/JP99/06179

§ 371 Date: May 8, 2001

§ 102(e) Date: May 8, 2001

(87) PCT Pub. No.: WO00/27589

PCT Pub. Date: May 18, 2000

(30) Foreign Application Priority Data

Nov. 9, 1998 (JP) ..... 10-317678

(51) Int. Cl.[7] ..... H01L 21/302; H01L 21/461

(52) U.S. Cl. ..... 438/692; 438/690; 438/959; 438/693; 216/2; 216/38; 216/88; 216/89; 216/99; 451/17; 451/41; 451/286; 451/287; 451/288; 451/526; 451/527

(58) Field of Search ..... 438/690, 692, 438/959, 693, 745, 748, 753, 754; 216/2, 38, 88, 89, 99; 451/17, 41, 286–288, 526, 527

(56) References Cited

U.S. PATENT DOCUMENTS 6,293,852 B1 * 9/2001 Roberts et al. ..... 451/41

FOREIGN PATENT DOCUMENTS

| | | |
|---|---|---|
| EP | 0 555 660 A2 | 8/1993 |
| EP | 0 658 401 A | 6/1995 |
| JP | 8-132342 A | 5/1996 |
| JP | 9-50974 A | 2/1997 |
| JP | 10-34525 A | 2/1998 |
| JP | 10-156724 A | 6/1998 |

* cited by examiner

*Primary Examiner*—John F. Niebling
*Assistant Examiner*—David A. Zarneke
(74) *Attorney, Agent, or Firm*—Morrison & Foerster LLP

(57) ABSTRACT

The present invention relates to a polishing pad which is characterized in that it has a polishing layer of rubber A-type microhardness at least 80° and a cushioning layer of bulk modulus at least 40 MPa and tensile modulus in the range 0.1 MPa to 20 MPa, and to a polishing device which is characterized in that a semiconductor substrate is fixed to the polishing head, and an aforesaid polishing pad is fixed to the polishing platen so that the polishing layer faces the semiconductor substrate, and by rotating the aforesaid polishing head or the polishing platen, or both, the semiconductor substrate is polished.

With the polishing device or polishing pad of the present invention for use in the mechanical planarizing process wherein the surface of the insulating layers or metal interconnects formed on a semiconductor substrate are smoothened, it is possible to uniformly planarize the entire semiconductor face and perform uniform polishing close up to the wafer edge and, furthermore, it is possible to provide a technique for achieving both uniformity and planarity under conditions of high platen rotation rate.

14 Claims, No Drawings

POLISHING PAD AND POLISHING DEVICE

TECHNICAL FIELD

The present invention relates to a semiconductor substrate polishing device and polishing pad; more particularly, it relates to a polishing device and a polishing pad for the mechanical planarization of the surface of insulating layers and the surface of metal interconnects formed on a silicon or other semiconductor substrate.

TECHNICAL BACKGROUND

Year by year, there are ever greater levels of integration in large scale integrated circuits (LSI) typified by semiconductor memories and, along with this, large scale integrated circuit production technology is providing ever greater packaging densities. Moreover, together with such increasingly high densities, the number of semiconductor device layers is also increasing. As a result of this increase in the number of layers, while not hitherto being an issue, the unevenness in the semiconductor wafer main face produced by such layering has become a problem. For example, as described in Nikkei Microdevice, July 1994, pages 50–57, the planarization of the semiconductor wafer using chemical mechanical polishing (CMC) techniques is being investigated with the objective of dealing with the inadequate depth of focus at the time of light exposure due to the unevenness produced by layering, or with the objective of raising interconnect densities by planarizing through-hole regions.

Generally speaking, CMP equipment is composed of a polishing head for holding the semiconductor substrate, which is the material undergoing treatment, a polishing pad for carrying out polishing of the material undergoing treatment, and a polishing platen for holding this polishing pad. In the semiconductor substrate polishing treatment, a slurry comprising polishing agent and chemical liquid is used and, by effecting relative motion between the semiconductor substrate and the polishing pad, the semiconductor substrate surface layer is smoothened. In the case, for example, of a silicon dioxide ($SiO_2$) film formed on a main face of the semiconductor substrate, the polishing rate at the time of this semiconductor substrate polishing process is roughly proportional to the relative velocity between semiconductor substrate and polishing pad, and the load. Hence, in order to bring about uniform polishing of each region of the semiconductor substrate, it is necessary to make the load applied to the semiconductor substrate uniform.

However, there are often variations in level over the entire surface of the semiconductor substrate held on the polishing head, due to inherent curvatures and other such variations in shape. Hence, it is desirable that there be used a soft polishing pad in order to apply a uniform load to each region of the semiconductor substrate. However, when a polishing process is carried out using a soft polishing pad, the planarity of the semiconductor substrate surface local unevenness is impaired. For example, the problem arises that in parts unevenness of the aforesaid semiconductor substrate surface layer is rounded by the polishing, that is to say the polished face is rounded and not made planar. In contrast, in the case where the polishing of the semiconductor substrate is carried out in the same way using a hard polishing pad then, while it is possible to enhance the planarity of the semiconductor substrate surface local unevenness unlike in the case of using a soft polishing pad, the hard polishing pad is unsatisfactory from the point of view of adapting to overall variations in level at the semiconductor substrate. For example, uneven regions of the semiconductor substrate surface where undulations project outwards are considerably polished, but uneven regions where such undulations are depressed are largely unpolished and remain as they are. Such non-uniform polishing leads to exposure of the aluminium interconnects and local variations in the thickness of the silicon dioxide insulating film following polishing and, for example, through-hole diameter irregularities and the fact that planarization of unevenness due to layer superposition is not possible, cause inadequate depth of focus at the time of light exposure.

With regard to the prior-art relating to polishing pads aimed at satisfying the opposing demands of enhancing such local planarity and overall adaptability, a two layer pad has been tried as described in JP-A-6-21028. The two layer pad described in JP-A-6-21028 has a construction where the polishing layer which directly contacts the semiconductor substrate is supported on a cushioning layer of bulk modulus no more than 250 psi/psi within the stress range 4 psi to 20 psi, and the polishing layer has a bulk modulus greater than this. The objective is that the cushioning layer absorbs overall variations in level on the semiconductor substrate, while the polishing layer is resistant to curvature over more than a certain area (for example more than the die spacing). However, with this conventional two-layer pad, the following problems still remain in terms of polishing performance. Firstly, even though the bulk modulus of the polishing layer is greater than the bulk modulus of the cushioning layer, the local planarity of the semiconductor substrate surface may still be impaired, and there is not necessarily a correlation between local planarity and the bulk modulus of the polishing layer. Secondly, since the bulk modulus of the cushioning layer is no more than 250 psi/psi within the stress range 4 psi to 20 psi, there is poor adaptability to variations in level over the semiconductor substrate as a whole, with the result that there is not obtained sufficient uniformity of planarity over the entire face of the semiconductor substrate. Furthermore, as stated on pages 177–183 of CMP Science by Science Forum Publishing (Co.), it has not been possible to fully resolve the question of how close to the edge within the wafer face is the required planarization to be carried out. Thirdly, if the rate of rotation of the polishing platen is high, the planarity is good but there is the problem that adaptability to the variations in level over the entire semiconductor substrate face is made worse. Consequently, an improved polishing device or polishing pad is required to overcome the above problems.

DISCLOSURE OF THE INVENTION

The objective of the present invention lies in offering a means for uniformly planarizing the entire face of a semiconductor substrate, in the case of a polishing device or a polishing pad employed in a mechanical planarizing process in which the surface of insulating layers or metal interconnects formed on a semiconductor substrate are smoothened by polishing. Specifically, this invention relates to "a polishing pad which is characterized in that it has a polishing layer of rubber A-type microhardness of at least 80° and a cushioning layer of bulk modulus at least 40 MPa and tensile modulus in the range 0.1 MPa to 20 MPa"

and

"a method of polishing a semiconductor substrate which is characterized in that the semiconductor substrate is fixed to a polishing head, and the semiconductor substrate is polished by rotating said polishing head or a polishing platen, or both, in a state where there is pressed against the semiconductor substrate a polishing layer of rubber A-type microhardness at least 80° affixed to the polishing platen via a cushioning layer of bulk modulus at least 40 MPa and tensile modulus 0.1 MPa to 20 MPa"

and also

"a polishing device which is characterized in that it is a polishing device equipped with a polishing head, a polishing pad which confronts the polishing head, a polishing platen to which the polishing pad is fixed, and a means for rotating the polishing head, the polishing platen or both of these, and where the polishing pad contains a cushioning layer of bulk modulus at least 40 MPa and tensile modulus in the range 0.1 to 20 MPa and, in the direction of the polishing head, a polishing layer of rubber A-type microhardness at least 80° ".

OPTIMUM MODE FOR PRACTISING THE INVENTION

Below, the mode of practising the invention is explained. The cushioning layer in the present invention needs to have a bulk modulus of at least 40 MPa and a tensile modulus in the range 0.1 MPa to 20 MPa. Preferably, the bulk modulus of the cushioning layer is at least 60 MPa and more preferably at least 90 MPa, and the preferred tensile modulus is 0.5 MPa to 18 MPa, and more preferably the tensile modulus is 5 MPa to 15 MPa. The bulk modulus is determined by applying an isotropic impressed pressure on the material subject to measurement, the volume of which has previously been measured, and then measuring the resulting change in volume. The bulk modulus is defined by the relation bulk modulus=impressed pressure/(change in volume/original volume). For example, if the original volume is 1 $cm^3$, and the volume change when an impressed pressure of 0.07 MPa is isotropically applied thereto is 0.00005 $cm^3$, then the bulk modulus is 1400 MPa. As an example of one method for measuring the bulk modulus, there is the method where the volume of the material undergoing measurement is first determined, after which said material undergoing measurement is immersed in water within a container, then this container introduced into a pressure vessel and pressure applied, and measurement made of the impressed pressure and the change in the volume of the material undergoing measurement based on the change in the height of the water in the container. With regard to the immersion liquid, it is preferred that there be avoided liquids which swell or damage the material undergoing measurement, but otherwise there are no particular restrictions on the liquid and examples are water, mercury, silicone oil and the like. The tensile modulus is determined by forming a dumbbell shape from the cushioning layer and applying a tensile stress thereto. The tensile stress is measured in the range of tensile strain (=change in length/original length) 0.01 to 0.03, and the tensile modulus is defined by the relation tensile modulus=((tensile stress at a tensile strain of 0.03)−(tensile stress at a tensile strain of 0.01))/0.02. As an example of the measurement instrument, there is the Tensilon general-purpose testing machine RTM-100 made by the Orientec Co. With regard to the measurement conditions, there is employed a testing rate of 5 cm/minute, and the test-piece shape is that of a dumbbell of width 5 mm and sample length 50 mm.

It is necessary that the bulk modulus of the cushioning layer be at least 40 MPa. If it is less than 40 MPa, then the uniformity of the planarity of the semiconductor substrate face as a whole is impaired, so this is undesirable. Furthermore, the tensile modulus of the cushioning layer needs to be in the range from 0.1 MPa to 20 MPa. If is less than 0.1 MPa, then the uniformity of the planarity of the semiconductor substrate face as a whole is impaired, so this is undesirable. If it exceeds 20 MPa, then again the uniformity of the planarity of the semiconductor substrate face as a whole is impaired, so this is undesirable. Examples of such a cushioning layer are unfoamed elastomers like natural rubber, nitrile rubber, neoprene rubber, polybutadiene rubber, polyurethane rubber and silicone rubber, but there are no particular restrictions thereto. The preferred thickness of the cushioning layer lies in the range 0.1 to 100 mm. If it is less than 0.1 mm, then the uniformity of the planarity of the semiconductor substrate face as a whole is impaired, so this is undesirable. If it exceeds 100 mm, then the local planarity is impaired, which is undesirable. The thickness range 0.2 to 5 mm is further preferred and 0.5 to 2 mm still further preferred. Next, explanation will be given of the rubber A-type microhardness referred to in the present invention. The rubber A-type microhardness denotes the value determined by means of a rubber microdurometer. This instrument is supplied by the Kobunshi Keiki Co., as rubber microdurometer model MD-1. With rubber microdurometer MD-1 it is possible to measure the hardness of small/thin samples which has been difficult to measure by conventional durometers. Since it has been designed and produced at abut $1/5^{th}$ the scale of the spring-system rubber durometer model A, the measured value obtained is a value which corresponds to the spring-system rubber durometer A-type hardness. In the case of an ordinary polishing pad, the polishing layer or hard layer thickness is cut to 5 mm, so it is too thin for the spring-system rubber durometer model A and evaluation is not possible, but evaluation is possible with the rubber microdurometer MD-1.

The polishing layer of the polishing pad of the present invention is a polishing layer of rubber A-type microhardness at least 80°. The rubber A-type microhardness needs to be at least 80° but is preferably at least 90°. If the rubber A-type microhardness is less than 80°, the global planarity of the semiconductor substrate local unevenness is poor, so this is undesirable. The tensile modulus of the cushioning layer of the polishing pad relating to the present invention is determined by forming a dumbbell shape of the polishing layer and applying a tensile stress thereto. The tensile stress is measured in the range of tensile strain (=change in length/original length) 0.01 to 0.03, and the tensile modulus is defined by the relation tensile modulus=((tensile stress at a tensile strain of 0.03)−(tensile stress at a tensile strain of 0.01))/0.02. As an example of the measurement instrument used, there is the Tensilon general-purpose testing machine RTM-100 made by the Orientec Co. With regard to the measurement conditions, there is employed a testing rate of 5 cm/minute, and the test-piece shape is that of a dumbbell of width 5 mm and sample length 50 mm. Where the polishing layer possesses closed cells, there is high polishing agent retention and the polishing rate is raised, so this is preferred. With regard to the closed cell diameter, where the average cell diameter is no more than 1000 $\mu$m there is excellent planarity of the semiconductor substrate local unevenness, so this is preferred. It is further preferred in terms of the closed cell diameter that the average cell diameter be no more than 500 $\mu$m and still more preferably no more than 300 $\mu$m.

It is preferred that the chief component of the polishing layer be polyurethane and that the density lies in the rang 0.7 to 0.9. If the density is less than 0.7, the polishing rate is lowered, which is undesirable. If the density exceeds 0.9, the polishing rate is lowered, which is undesirable. A still further preferred polishing layer contains polyurethane and a polymer obtained by polymerization of a vinyl compound where the content of this polymer obtained by polymerization of a vinyl compound is from 50 wt % to 90 wt %, and which has closed cells of average cell diameter no more than 1000 μm and a density of 0.4 to 1.1. This polyurethane is a polymer synthesized based on a polyisocyanate polyaddition or polymerization reaction. The compound employed to react with the polyisocyanate is a compound containing active hydrogens, that is to say a polyhydroxy or amino group-containing compound with two or more active hydrogens. Examples of the polyisocyanate are tolylene diisocyanate, diphenylmethane diisocyanate, naphthalene diisocyanate, tolidine diisocyanate, hexamethylene diisocyanate and isophorone diisocyanate, but there is no restriction to these. Polyhydroxy compounds are typified by polyols, and as examples of polyols there are polyether-polyols, polyoxytetramethylene glycol, epoxy resin-modified polyols, polyester-polyols, acrylic polyols, polybutadiene polyols, silicone polyols and the like.

Vinyl compound in the present invention means a compound with a polymerizable carbon-carbon double bond. Specific examples are methyl methacrylate, ethyl methacrylate, propyl methacrylate, n-butyl methacrylate, isobutyl methacrylate, methyl (α-ethyl)acrylate, ethyl (α-ethyl)acrylate, propyl (α-ethyl)acrylate, butyl (α-ethyl) acrylate, 2-ethylhexyl methacrylate, isodecyl methacrylate, n-lauryl methacrylate, 2-hydroxyethyl methacrylate, 2-hydroxypropyl methacrylate, 2-hydroxyethyl acrylate, 2-hydroxypropyl acrylate, 2-hydroxybutyl methacrylate, dimethylaminoethyl methacrylate, diethylaminoethyl methacrylate, methacrylic acid, glycidyl methacrylate, ethylene glycol dimethacrylate, fumaric acid, dimethyl fumarate, diethyl fumarate, dipropyl fumarate, maleic acid, dimethyl maleate, diethyl maleate, dipropyl maleate, acrylonitrile, acrylamide, vinyl chloride, styrene, α-methylstyrene and the like. Of these, preferred vinyl compounds are methyl methacrylate, ethyl methacrylate, propyl methacrylate, n-butyl methacrylate, isobutyl methacrylate, methyl (α-ethyl)acrylate, ethyl (α-ethyl) acrylate, propyl (α-ethyl)acrylate and butyl( α-ethyl) acrylate. Specifically, there are methyl methacrylate, ethyl methacrylate, n-butyl methacrylate, isobutyl methacrylate, 2-ethylhexyl methacrylate, isodecyl methacrylate, n-lauryl methacrylate, 2-hydroxyethyl methacrylate, 2-hydroxypropyl methacrylate, 2-hydroxyethyl acrylate, 2-hydroxypropyl acrylate, 2-hydroxybutyl methacrylate, dimethylaminoethyl methacrylate, diethylaminoethyl methacrylate, methacrylic acid, glycidyl methacrylate, ethylene glycol dimethacrylate, fumaric acid, dimethyl fumarate, diethyl fumarate, dipropyl fumarate, maleic acid, dimethyl maleate, diethyl maleate, dipropyl maleate, acrylonitrile, acrylamide, vinyl chloride, styrene, α-methylstyrene and the like. Of these, preferred vinyl compounds are methyl methacrylate, ethyl methacrylate, propyl methacrylate, n-butyl methacrylate, isobutyl methacrylate, methyl (α-ethyl)acrylate, -ethyl (α-ethyl) acrylate, propyl (α-ethyl)acrylate and butyl (α-ethyl) acrylate. The aforesaid preferred vinyl compounds readily impregnate polyurethanes and, when polymerization is carried out within the polyurethane, there is obtained a polishing layer of high hardness and high toughness, and so they are preferred. As examples of the polymers derived from the polymerization of the vinyl compound in the present invention, there are polymethyl methacrylate, polyethyl methacrylate, polypropyl methacrylate, poly(n-butyl methacrylate), polyisobutyl methacrylate, polymethyl (α-ethyl)acrylate, polyethyl (α-ethyl)acrylate, polypropyl (α-ethyl)acrylate, polybutyl (α-ethyl)acrylate, poly(2-ethylhexyl methacrylate), polyisodecyl methacrylate, poly (n-lauryl methacrylate), poly(2-hydroxyethyl methacrylate), poly(2-hydroxypropyl methacrylate), poly(2-hydroxyethyl acrylate), poly(2-hydroxypropyl acrylate), poly(2-hydroxybutyl methacrylate), polydimethylaminoethyl methacrylate, polydiethylaminoethyl methacrylate, polymethacrylic acid, polyglycidyl methacrylate, polyethylene glycol dimethacrylate, polyfumaric acid, polydimethyl fumarate, polydiethyl fumarate, polydipropyl fumarate, polymaleic acid, polydimethyl maleate, polydiethyl maleate, polydipropyl maleate, polyacrylonitrile, polyacrylamide, polyvinyl chloride, polystyrene, poly(α-methylstyrene) and the like. Of these, as preferred polymers, polymethyl methacrylate, polyethyl methacrylate, polypropyl methacrylate, poly(n-butyl methacrylate), polyisobutyl methacrylate, polymethyl (α-ethyl)acrylate, polyethyl (α-ethyl)acrylate, polypropyl (α-ethyl)acrylate and polybutyl (α-ethyl)acrylate can raise the hardness of the polishing pad and the planarization characteristics can be improved. It is preferred that the content of the polymer obtained by polymerization of the vinyl compound in the present invention be at least 50 wt % and up to 90 wt %. If the content of the polymer derived from the vinyl monomer is less than 50 wt %, the hardness of the polishing layer will be lowered, so this is undesirable. If the amount exceeds 90 wt %, the elasticity of the polishing layer is impaired, so this is undesirable.

With regard to the method of producing the polishing layer of the present invention, a preferred method is the method in which a foamed polyurethane sheet having closed cells of average cell diameter no more than 1000 μm and having a density in the range 0.1 to 1.0, is swollen beforehand with the vinyl compound, after which polymerization of the vinyl compound is carried out within the foamed polyurethane sheet. In this way, it is possible to produce a polishing layer containing both polyurethane with a closed cell structure and polymer derived from the vinyl compound. Of course, it is necessary to determine the combination and optimum amounts of polyisocyanate, polyol, catalyst, foam regulator and foaming agent in accordance with the target polishing layer hardness, cell diameter and density.

As examples of the method employed for polymerizing the vinyl compound within the foamed polyurethane sheet following the swelling of the foamed polyurethane sheet by means of the vinyl compound, there are the method of carrying out the swelling with a vinyl compound together with a photo radical initiator and then bringing about polymerization by exposure to light, the method of carrying out the swelling with a vinyl compound together with a thermal radical initiator and then bringing about polymerization by application of heat, and the method of carrying out the swelling with a vinyl compound and then bringing about polymerization by exposure to an electron beam or to radiation.

In the present invention, affixing the polishing layer to the polishing platen via a cushioning layer, refers to fixing in such a way that the cushioning layer does not slip from the polishing platen at the time of polishing and, furthermore, fixing in such a way that the polishing layer does not slip from the cushioning layer. As the method for fixing together the cushioning layer and the polishing platen, there may be considered the method of fixing with double-sided adhesive tape, the method of fixing with an adhesive agent or the method of applying suction from the polishing platen to fix the cushioning layer, but there is no particular restriction on the method used. As the method for fixing the polishing layer to the cushioning layer, there may be considered the method of fixing with double-sided adhesive tape or the method of fixing with an adhesive agent, but there is no particular restriction on the method used. Double-sided tape or an adhesive agent layer can be used as an intermediate layer for coupling together the polishing layer and the cushioning layer. It is preferred that the tensile modulus of this double-sided adhesive tape or adhesive layer be no more than 20 MPa. The tensile modulus of double-sided adhesive tape is determined by forming a dumbbell shape and applying a tensile stress thereto. The tensile stress is measured in the range of tensile strain (=change in length/original length) 0.01 to 0.03, and the tensile modulus is defined by the relation tensile modulus=((tensile stress at a tensile strain of 0.03)−(tensile stress at a tensile strain of 0.01))/0.02. The tensile modulus of the adhesive layer is determined by first producing a laminate by application of the adhesive layer between two sheets of rubber of known tensile modulus, then producing a dumbbell shape and performing an evaluation of the tensile modulus, after which there is applied the formula ((tensile modulus of the laminate)×(thickness of the laminate)−2×(tensile modulus of the rubber)×(thickness of one sheet of rubber))÷(thickness of the adhesive layer). As an example of the measurement instrument, there is the Tensilon general-purpose testing machine RTM-100 produced by the Orientec Co. With regard to the measurement conditions, there is employed a testing rate of 5 cm/minute, and the test-piece shape is that of a dumbbell of width 5 mm and sample length 50 mm. If the tensile modulus of the intermediate layer exceeds 20 MPa, the uniformity within the face is impaired, so this is undesirable.

Preferred specific examples of the double-sided adhesive tape or adhesive layer for sticking together the polishing layer and the cushioning layer are Sumitomo 3M (Ltd) double-sided adhesive tapes 463, 465 and 9204, Nitto Denko (Corp.) double-sided adhesive tape No.591 and other such substrate-free acrylic adhesive transfer tapes, double-sided adhesive tape with a foamed sheet substrate such as Y-4913 produced by Sumitomo 3M (Ltd), and double-sided adhesive tape with a nonrigid vinyl chloride substrate such as 447DL produced by Sumitomo 3M (Ltd).

With the polishing device in the present invention, in cases where, for reasons such as the polishing rate not being realized, it is necessary to replace the polishing layer after polishing, it is also possible to remove the polishing layer from the cushioning layer and to replace it while the cushioning layer remains fixed to the polishing platen. The cushioning layer is durable when compared to the polishing layer, so replacing just the polishing layer is advantageous in terms of cost.

Below, the method of polishing a semiconductor substrate using the polishing pad according to the present invention is explained.

It is possible to planarize unevenness on the semiconductor substrate insulating films or metal interconnects using the polishing pad of the present invention by employing for example a silica-based polishing agent, an aluminium oxide based polishing agent or a cerium oxide based polishing agent as the polishing agent. Firstly, there is prepared the polishing device which is equipped with a polishing head, a polishing platen for fixing the polishing pad, and a means for effecting rotation of the polishing head, the polishing platen or both. Then, the polishing pad of the present invention is affixed to the polishing platen of the polishing device in such a way that the polishing layer confronts the polishing head. The semiconductor substrate is fixed by a method such as a vacuum chuck to the polishing head. The polishing platen is made to rotate, and the polishing head is made to rotate in the same direction as the polishing platen and pressed against the polishing pad. At this time, polishing agent is supplied between the polishing pad and the semiconductor substrate from a position such that polishing agent can be introduced. Normally, the pressing pressure is controlled by the force applied to the polishing head. Where this is in the range 0.01 to 0.2 MPa, local planarity is obtained, so this is preferred.

By means of the polishing device and polishing pad of the present invention, it is possible to achieve uniformity in terms of the planarity of the local unevenness over the entire face of the semiconductor substrate, and it is possible to achieve uniform polishing close up to the wafer edge. Furthermore, it is possible to achieve both uniformity and planarity under conditions of high platen rotation rate.

EXAMPLES

Below, the details of the present invention are further explained along with examples. In these examples, the various properties were measured by the following methods.

1. Rubber A-type Microhardness:

Measurement was carried out with a Kobunshi Keiki (Co.) [address: Shimodachiuri Muromachi Nishiiri, Kamigyo-ku, Kyoto] rubber microdurometer MD-1.

The structure of the rubber microdurometer MD-1 was as follows.

1.1 Sensor Region (1) Loading system: cantilever plate spring type

| | | |
|---|---|---|
| (2) Spring load: | 0 point | 2.24 gf |
| | 100 point | 33.85 gf |

(3) Spring load error: ±0.32 gf

| | | | |
|---|---|---|---|
| (4) Indenter dimensions: | diam: | 0.16 mm | circular cylinder |
| | height | 0.5 mm | |

(5) Displacement detection system: strain gauge

| | | |
|---|---|---|
| (6) Pressure foot dimensions: | outer diameter | 4 mm |
| | inner diameter | 1.5 mm |

1.2 Sensor Driving Region (1) Driving system: vertically driven based on a stepping motor, descending rate control based on an air damper (2) Vertical stroke: 12 mm (3) Rate of descent: 10–30 mm/sec (4) Height adjustment range: 0 to 67 mm (distance between sample table and sensor pressure face)

1.3 Sample Stand (1) Sample stand dimension: diameter 80 mm (2) Fine adjustment mechanism: fine adjustment based on XY table and micrometer head; stroke for both X and Y axes=15 mm (3) Level adjustment means: main feet for level adjustment and round spirit level 2. Global Step Height (1) Test Wafer A 20 mm square die was arranged on a 6-inch silicon wafer. On the left half of this 20 mm square die, there were provided aluminium interconnects of width 40 μm and height 1.2 μm, at a spacing of 40 μm, in line-and-space fashion, and on the right half there were provided aluminium interconnects of width 400 μm and height 1.2 μm, at a spacing of 40 μm, in line-and-space fashion. Furthermore, on top thereof, an insulating film of 3 μm thickness was formed by CVD using tetraethoxysilane, to prepare the test wafer for evaluation of the global step height.

(2) Evaluation Method

Evaluation Conditions A

The test wafer for evaluation of the global step height was fitted to the polishing head of the polishing machine and made to rotate at 37 rpm. The composite polishing pad was fixed to the polishing machine platen and made to rotate at 36 rpm in the same direction as the direction of rotation of the polishing head. While supplying a silica-based polishing agent at 200 ml/minute, polishing was carried out for a specified time at a polishing pressure of 0.05 MPa. The global step height between the 40 μm width and 400 μm width interconnect regions of the global step height evaluation test wafer was measured.

Evaluation Conditions B

The test wafer for evaluation of the global step height was fitted to the polishing head of the polishing machine and made to rotate at 47 rpm. The composite polishing pad was fixed to the polishing machine platen and made to rotate at 46 rpm in the same direction as the direction of rotation of the polishing head. While supplying a silica-based polishing agent at 200 ml/minute, polishing was carried out for a specified time at a polishing pressure of 0.05 MPa. The global step height between the 40 μm width and 400 μm width interconnect regions of the global step height evaluation test wafer was measured.

3. OXIDE FILM REMOVAL RATE (1) Test Wafer

A 1.2 μm thermally-oxidized film was formed on a 6-inch test wafer, to produce the test wafer for evaluation of the oxide film removal rate.

(2) Evaluation Method

Evaluation Conditions C

The test wafer for evaluation of the oxide film removal rate was fitted to the polishing head of the polishing machine and made to rotate at 37 rpm, and the polishing pad was affixed to the polishing machine platen and made to rotate at 36 rpm in the same direction as the direction of rotation of the polishing head. While supplying a silica-based polishing agent at 225 ml/minute, polishing was carried out for 3 minutes at a polishing pressure of 0.05 MPa. The oxide film removal rate was measured at 1 mm spacings within 5 mm of the wafer edge, and the average oxide film removal rate and the uniformity within 5 mm of the wafer edge where uniformity=(maximum oxide removal rate−minimum oxide removal rate)÷2÷average oxide removal rate×100, were calculated. Furthermore, the oxide film removal rate was measured at 1 mm spacings within 3 mm of the wafer edge, and the average oxide film removal rate and the uniformity within 3 mm of the wafer edge where uniformity=(maximum oxide removal rate−minimum oxide removal rate)÷2÷average oxide removal rate×100, were calculated.

Evaluation Conditions D

The test wafer for evaluation of the oxide film removal rate was fitted to the polishing head of the polishing machine and made to rotate at 47 rpm, and the polishing pad was affixed to the polishing machine platen and made to rotate at 46 rpm in the same direction as the direction of rotation of the polishing head. While supplying a silica-based polishing agent at 225 ml/minute, polishing was carried out for 3 minutes at a polishing pressure of 0.05 MPa. The oxide film removal rate was measured at 1 mm spacings within 5 mm of the wafer edge, and the average oxide film removal rate and the uniformity within 5 mm of the wafer edge where uniformity=(maximum oxide removal rate−minimum oxide removal rate)÷2÷average oxide removal rate×100, were calculated. Furthermore, the oxide film removal rate was measured at 1 mm spacings within 3 mm of the wafer edge, and the average oxide film removal rate and the uniformity within 3 mm of the wafer edge where uniformity=(maximum oxide removal rate−minimum oxide removal rate)÷2÷average oxide removal rate×100, were calculated.

Example 1

A foamed polyurethane sheet (rubber A-type microhardness=50°, density: 0.77 and average diameter of closed cells: 110 μm) of thickness 5 mm was immersed for 24 hours in methyl methacrylate to which 0.1 part by weight of azobisisobutyronitrile had been added. The foamed polyurethane sheet which had been swollen by the methyl methacrylate was then interposed between glass plates and heated for 24 hours at 70° C. After heating, it was removed from the glass plates and dried under vacuum at 50° C. It was then subjected to grinding and a polishing layer of thickness 1.2 mm obtained. The rubber A-type microhardness of this polishing layer was 98°, density: 0.79, average diameter of closed cells: 150 μm, and the proportion by weight of polymethyl methacrylate was 69 wt %. A polishing pad was produced by sticking together this polishing layer and a 1 mm nitrile rubber (bulk modulus=140 MPa, tensile modulus=4.5 MPa) cushioning layer with Nitto Denko double-sided adhesive tape No.591 (tensile modulus no more than 0.1 MPa). Using a silica-type polishing agent, the evaluation of the oxide film removal rate was carried out under evaluation conditions C at a platen rotation rate of 36 rpm. The average oxide film removal rate within 5 mm of the wafer edge was 1020 Å/minute and the uniformity 8, and the average oxide film removal rate within 3 mm of the wafer edge was 1050 Å/minute and the uniformity 10. Furthermore, when evaluation conditions D were used at a platen rotation rate of 46 rpm, the average oxide film removal rate within 5 mm of the wafer edge was 1340 Å/minute and the uniformity 7, while the average oxide film removal rate within 3 mm of the wafer edge was 1350 Å/minute and the uniformity 11. When an evaluation was carried out of the global step height under evaluation conditions A at a platen rotation rate of 36 rpm for a polishing time of 2 minutes, the global step height between the 40 μm width and 400 μm width interconnect regions of the global step height evaluation test wafer was 0.04 μm. Again, when the global step height was evaluated under evaluation conditions B at a platen rotation rate of 46 rpm for a polishing time of 1 minute 45 seconds, the global step height between the 40 μm width and 400 μm width interconnect regions of the global step height evaluation test wafer was 0.01 μm.

Example 2

30 parts by weight of polypropylene glycol, 40 parts by weight of diphenylmethane diisocyanate, 0.8 parts by weight of water, 0.3 parts by weight of triethylamine, 1.7 parts by weight of silicone foam stabilizer and 0.09 parts by weight of tin octylate were mixed together in an RIM moulding machine, discharged into a mould and subjected to pressure moulding, to produce a foamed polyurethane sheet (rubber A-type microhardness=50°, density: 0.51 and average diameter of closed cells: 40 μm) of thickness 1.5 mm. This foamed polyurethane sheet was immersed for 15 hours in methyl methacrylate to which 0.1 part by weight of azobisisobutyronitrile had been added. The foamed polyurethane sheet which had been swollen by the methyl methacrylate was interposed between glass plates and heated for 24 hours at 70° C. After heating, it was removed from the glass plates and dried under vacuum at 50° C. The hard foamed sheet obtained was then subjected to grinding at both faces and a 1.2 mm polishing pad obtained. The rubber A-type microhardness of this polishing pad was 980, density: 0.75, average diameter of closed cells: 60 μm and the polymethyl methacrylate content of the polishing pad was 82 wt %. 2 mm polyurethane rubber (bulk modulus=100 MPa, tensile modulus=10 MPa) was prepared as a cushioning layer, and a polishing pad was produced by sticking together the polishing layer and the cushioning layer with Sumitomo 3M (Ltd) double-sided adhesive tape #950 (tensile modulus no more than 0.1 Mpa). Using a silica-type polishing agent, the evaluation of the oxide film removal rate was carried out under evaluation conditions C at a platen rotation rate of 36 rpm. The average oxide film removal rate within 5 mm of the wafer edge was 1210 Å/minute and the uniformity 7, and the average oxide film removal rate within 3 mm of the wafer edge was 1230 Å/minute and the uniformity 10. Furthermore, when evaluation conditions D were used at a platen rotation rate of 46 rpm, the average oxide film removal rate within 5 mm of the wafer edge was 1540 Å/minute and the uniformity 9, and the average oxide film removal rate within 3 mm of the wafer edge was 1560 Å/minute and the uniformity 11. When an evaluation was carried out of the global step height under evaluation conditions A at a platen rotation rate of 36 rpm for a polishing time of 1 minute 45 seconds, the global step height between the 40 μm width and 400 μm width interconnect regions of the global step height evaluation test wafer was 0.04 μm. Again, when the global step height was evaluated under evaluation conditions B at a platen rotation rate of 46 rpm for a polishing time of 1 minute 30 seconds, the global step height between the 40 μm width and 400 μm width interconnect regions of the global step height evaluation test wafer was 0.02 μm.

Example 3

78 parts by weight of a polyether-based -urethane polymer (Adiprene L-325, produced by Uniroyal), 20 parts by weight of 4,4'-methylene-bis2-chloroaniline and 1.8 parts by weight of hollow polymer microspheres (Expancel 551 DE produced by the Chema-Nobel Co.) were mixed together in an RIM moulding machine, and discharged into a mould to produce a moulded polymer body. This moulded polymer body was sliced to a thickness of 1.2 mm with a slicer, to produce the polishing layer. The rubber A-type microhardness of this polishing layer was 980, density: 0.80, average diameter of closed cells: 33 μm. 1 mm neoprene rubber (bulk modulus=100 MPa, tensile modulus=12 MPa) was prepared as a cushioning layer, and a polishing pad was produced by sticking together the polishing layer and the cushioning layer with Sumitomo 3M (Ltd) double-sided adhesive tape Y-949 (tensile modulus 10 Mpa). Using a silica-type polishing agent, the evaluation of the oxide film removal rate was carried out under evaluation conditions C at a platen rotation rate of 36 rpm. The average oxide film removal rate within 5 mm of the wafer edge was 1110 Å/minute and the uniformity 6, and the average oxide film removal rate within 3 mm of the wafer edge was 1130 Å/minute and the uniformity 10. Furthermore, when evaluation conditions D were used at a platen rotation rate of 46 rpm, the average oxide film removal rate within 5 mm of the wafer edge was 1340 Å/minute and the uniformity 9, and the average oxide film removal rate within 3 mm of the wafer edge was 1360 Å/minute and the uniformity 11. When an evaluation was carried out of the global step height under evaluation conditions A at a platen rotation rate of 36 rpm for a polishing time of 2 minutes, the global step height between the 40 μm width and 400 μm width interconnect regions of the global step height evaluation test wafer was 0.06 μm. Again, when the global step height was evaluated under evaluation conditions B at a platen rotation rate of 46 rpm for a polishing time of 1 minute 45 seconds, the global step height between the 40 μm width and 400 μm width interconnect regions of the global step height evaluation test wafer was 0.04 μm.

Example 4

The polishing layer employed in Example 1 was used. A polishing pad was produced by sticking a 1.5 mm chloroprene rubber (bulk modulus=80 MPa, tensile modulus=10 MPa) cushioning layer to this polishing layer with Nitto Denko double-sided adhesive tape No.591 (tensile modulus no more than 0.1 Mpa). Using a silica-type polishing agent, the evaluation of the oxide film removal rate was carried out under evaluation conditions C at a platen rotation rate of 36 rpm. The average oxide film removal rate within 5 mm of the wafer edge was 1030 Å/minute and the uniformity 8, and the average oxide film removal rate within 3 mm of the wafer edge was 1060 Å/minute and the uniformity 10. Furthermore, when evaluation conditions D were used at a platen rotation rate of 46 rpm, the average oxide film removal rate within 5 mm of the wafer edge was 1310 Å/minute and the uniformity 10, and the average oxide film removal rate within 3 mm of the wafer edge was 1360 Å/minute and the uniformity 12. When an evaluation was carried out of the global step height under evaluation conditions A at a platen rotation rate of 36 rpm for a polishing time of 2 minutes, the global step height between the 40 μm width and 400 μm width interconnect regions of the global step height evaluation test wafer was 0.04 μm. Again, when the global step height was evaluated under evaluation conditions B at a platen rotation rate of 46 rpm for a polishing time of 1 minute 45 seconds, the global step height between the 40 μm width and 400 μm width interconnect regions of the global step height evaluation test wafer was 0.01 μm.

Example 5

The polishing layer employed in Example 1 was used. A polishing pad was produced by sticking a 1 mm chloroprene rubber (bulk modulus=50 MPa, tensile modulus=11 MPa) cushioning layer to this polishing layer with Nitto Denko double-sided adhesive tape No.591 (tensile modulus no more than 0.1 Mpa). Using a silica-type polishing agent, the evaluation of the oxide film removal rate was carried out under evaluation conditions C at a platen rotation rate of 36 rpm. The average oxide film removal rate within 5 mm of the wafer edge was 1050 Å/minute and the uniformity 7, and the average oxide film removal rate within 3 mm of the wafer edge was 1070 Å/minute and the uniformity 11. Furthermore, when evaluation conditions D were used at a platen rotation rate of 46 rpm, the average oxide film removal rate within 5 mm of the wafer edge was 1370 Å/minute and the uniformity 11, and the average oxide film removal rate within 3 mm of the wafer edge was 1350 Å/minute and the uniformity 14. When an evaluation was carried out of the global step height under evaluation conditions A at a platen rotation rate of 36 rpm for a polishing time of 2 minutes, the global step height between the 40 μm width and 400 μm width interconnect regions of the global step height evaluation test wafer was 0.04 μm. Again, when the global step height was evaluated under evaluation conditions B at a platen rotation rate of 46 rpm for a polishing time of 1 minute 45 seconds, the global step height between the 40 μm width and 400 μm width interconnect regions of the global step height evaluation test wafer was 0.01 μm.

Example 6

The polishing layer employed in Example 1 was used. A polishing pad was produced by sticking a 0.5 mm ethylene-propylene rubber (bulk modulus=100 MPa, tensile modulus 19 MPa) cushioning layer to this polishing layer with Nitto Denko double-sided adhesive tape No.591 (tensile modulus no more than 0.1 Mpa). Using a silica-type polishing agent, the evaluation of the oxide film removal rate was carried out under evaluation conditions C at a platen rotation rate of 36 rpm. The average oxide film removal rate within 5 mm of the wafer edge was 1000 Å/minute and the uniformity 6, and the average oxide film removal rate within 3 mm of the wafer edge was 960 Å/minute and the uniformity 10. Furthermore, when evaluation conditions D were used at a platen rotation rate of 46 rpm, the average oxide film removal rate within 5 mm of the wafer edge was 1270 Å/minute and the uniformity 10, and the average oxide film removal rate within 3 mm of the wafer edge was 1290 Å/minute and the uniformity 12. When an evaluation was carried out of the global step height under evaluation conditions A at a platen rotation rate of 36 rpm for a polishing time of 2 minutes, the global step height between the 40 μm width and 400 μm width interconnect regions of the global step height evaluation test wafer was 0.04 μm. Again, when the global step height was evaluated under evaluation conditions B at a platen rotation rate of 46 rpm for a polishing time of 1 minute 45 seconds, the global step height between the 40 μm width and 400 μm width interconnect regions of the global step height evaluation test wafer was 0.01 μm.

Example 7

The polishing layer employed in Example 1 was used. A polishing pad was produced by sticking a 1.5 mm ethylene-propylene rubber (bulk modulus=110 MPa, tensile modulus=16 MPa) cushioning layer to this polishing layer with Nitto Denko double-sided adhesive tape No.591 (tensile modulus no more than 0.1 Mpa). Using a silica-type polishing agent, the evaluation of the oxide film removal rate was carried out under evaluation conditions C at a platen rotation rate of 36 rpm. The average oxide film removal rate within 5 mm of the wafer edge was 990 Å/minute and the uniformity 7, and the average oxide film removal rate within 3 mm of the wafer edge was 1000 Å/minute and the uniformity 11. Furthermore, when evaluation conditions D were used at a platen rotation rate of 46 rpm, the average oxide film removal rate within 5 mm of the wafer edge was 1370 Å/minute and the uniformity 12, and the average oxide film removal rate within 3 mm of the wafer edge was 1390 Å/minute and the uniformity 14. When an evaluation was carried out of the global step height under evaluation conditions A at a platen rotation rate of 36 rpm for a polishing time of 2 minutes, the global step height between the 40 μm width and the 400 μm width interconnect regions of the global step height evaluation test wafer was 0.04 μm. Again, when the global step height was evaluated under evaluation conditions B at a platen rotation rate of 46 rpm for a polishing time of 1 minute 45 seconds, the global step height between the 40 μm width and 400 μm width interconnect regions of the global step height evaluation test wafer was 0.01 μm.

Example 8

The polishing layer employed in Example 1 was used. A polishing pad was produced by sticking a 1.5 mm silicone rubber (bulk modulus=120 MPa, tensile modulus=0.7 MPa) cushioning layer to this polishing layer with Nitto Denko double-sided adhesive tape No.591 (tensile modulus no more than 0.1 Mpa). Using a silica-type polishing agent, the evaluation of the oxide film removal rate was carried out under evaluation conditions C at a platen rotation rate of 36 rpm. The average oxide film removal rate within 5 mm of the wafer edge was 1100 Å/minute and the uniformity 7, and the average oxide film removal rate within 3 mm of the wafer edge was 1130 Å/minute and the uniformity 11. Furthermore, when evaluation conditions D were used at a platen rotation rate of 46 rpm, the average oxide film removal rate within 5 mm of the wafer edge was 1330 Å/minute and the uniformity 9, and the average oxide film removal rate within 3 mm of the wafer edge was 1370 Å/minute and the uniformity 12. When an evaluation was carried out of the global step height under evaluation conditions A at a platen rotation rate of 36 rpm for a polishing time of 2 minutes, the global step height between the 40 μm width and the 400 μm width interconnect regions of the global step height evaluation test wafer was 0.04 μm. Again, when the global step height was evaluated under evaluation conditions B at a platen rotation rate of 46 rpm for a polishing time of 1 minute 45 seconds, the global step height between the 40 μm width and 400 μm width interconnect regions of the global step height evaluation test wafer was 0.01 μm.

Comparative Example 1

The polishing layer employed in Example 3 was prepared. The rubber A-type microhardness of the polishing layer was 98°, density: 0.80 and the average diameter of closed cells: 33 μm. As the cushioning layer, there was prepared a wet-foamed polyurethane (bulk modulus=3 MPa, tensile modulus=50 MPa) of thickness 1.2 mm obtained by wet film formation following impregnation of a nonwoven material with a polyurethane solution. A polishing pad was produced by sticking together the polishing layer and the cushioning layer with Sumitomo 3M (Ltd) double-sided adhesive tape 442J (a double-sided adhesive tape in which the substrate is polyester film; tensile modulus=200 MPa). Using a silica-type polishing agent, the evaluation of the oxide film removal rate was carried out under evaluation conditions C at a platen rotation rate of 36 rpm. The average oxide film removal rate within 5 mm of the wafer edge was 1150 Å/minute and the uniformity 10, and the average oxide film removal rate within 3 mm of the wafer edge was 1130 Å/minute and the uniformity 17. Furthermore, when evaluation conditions D were used at a platen rotation rate of 46 rpm, the average oxide film removal rate within 5 mm of the wafer edge was 1370 Å/minute and the uniformity 17, and the average oxide film removal rate within 3 mm of the wafer edge was 1360 Å/minute and the uniformity 20. Thus, the uniformity was poor. When an evaluation was carried out of the global step height under evaluation conditions A at a platen rotation rate of 36 rpm for a polishing time of 2 minutes, the global step height between the 40 μm width and 400 μm width interconnect regions of the global step height evaluation test wafer was 0.06 μm. Again, when the global step height was evaluated under evaluation conditions B at a platen rotation rate of 46 rpm for a polishing time of 1 minute 45 seconds, the global step height between the 40 μm width and 400 μm width interconnect regions of the global step height evaluation test wafer was 0.04 μm.

Comparative Example 2

There was produced a polishing layer of foamed polyurethane obtained by wet film formation following impregnation of a nonwoven material comprising polyester fibre (fibre diameter 6 μm) with a polyurethane solution. The rubber A-type microhardness of this polishing layer was 75°. As the cushioning layer, there was prepared a wet-foamed polyurethane (bulk modulus=3 MPa, tensile modulus=50 MPa) of thickness 1.2 mm, which was obtained by wet film formation following impregnation of a nonwoven material with a polyurethane solution. A polishing pad was produced by sticking together this polishing layer and cushioning layer with Sumitomo 3M (Ltd) double-sided adhesive tape 442J (double-sided adhesive tape in which the substrate is polyester film; tensile modulus=200 MPa). Using a silica-type polishing agent, the evaluation of the oxide film removal rate was carried out under evaluation conditions C at a platen rotation rate of 36 rpm. The average oxide film removal rate within 5 mm of the wafer edge was 850 Å/minute and the uniformity 6, and the average oxide film removal rate within 3 mm of the wafer edge was 890 Å/minute and the uniformity 7. Furthermore, when evaluation conditions D were used at a platen rotation rate of 46 rpm, the average oxide film removal rate within 5 mm of the wafer edge was 1010 Å/minute and the uniformity 6, and the average oxide film removal rate within 3 mm of the wafer edge was 1050 Å/minute and the uniformity 8. When an evaluation was carried out of the global step height under evaluation conditions A at a platen rotation rate of 36 rpm for a polishing time of 2 minutes, the global step height between the 40 μm width and the 400 μm width interconnect regions of the global step height evaluation test wafer was 0.15 μm. Again, when the global step height was evaluated under evaluation conditions B at a platen rotation rate of 46 rpm for a polishing time of 1 minute 45 seconds, the global step height between the 40 μm width and 400 μm width interconnect regions of the global step height evaluation test wafer was 0.10 μm. Thus, the global step height was poor.

Comparative Example 3

The polishing layer employed in Example 3 was prepared. The rubber A-type microhardness of the polishing layer was 98°, density: 0.80 and the average diameter of the closed cells: 33 μm. As the cushioning layer, there was prepared a 1 mm sheet of polybutylene terephthalate (bulk modulus=600 MPa, tensile modulus=100 MPa). A polishing pad was produced by sticking together this polishing layer and cushioning layer with Sumitomo 3M (Ltd) double-sided adhesive tape Y-949 (tensile modulus 10 MPa). Using a silica-type polishing agent, the evaluation of the oxide film removal rate was carried out under evaluation conditions C at a platen rotation rate of 36 rpm. The average oxide film removal rate within 5 mm of the wafer edge was 1150 Å/minute and the uniformity 20, and the average oxide film removal rate within 3 mm of the wafer edge was 1130 Å/minute and the uniformity 25. Furthermore, when evaluation conditions D were used at a platen rotation rate of 46 rpm, the average oxide film removal rate within 5 mm of the wafer edge was 1370 Å/minute and the uniformity 21, while the average oxide film removal rate within 3 mm of the wafer edge was 1360 Å/minute and the uniformity 23. Thus the uniformity was poor. When an evaluation was carried out of the global step height under evaluation conditions A at a platen rotation rate of 36 rpm for a polishing time of 2 minutes, the global step height between the 40 μm width and 400 μm width interconnect regions of the global step height evaluation test wafer was 0.06 μm. Again, when the global step height was evaluated under evaluation conditions B at a platen rotation rate of 46 rpm for a polishing time of 1 minute 45 seconds, the global step height between the 40 μm width and 400 μm width interconnect regions of the global step height evaluation test wafer was 0.04 μm.

Comparative Example 4

The polishing layer employed in Example 3 was prepared. As the cushioning layer, there was prepared 1 mm neoprene rubber (bulk modulus=100 MPa, tensile modulus=12 MPa), and a polishing pad was produced by sticking together the polishing layer and cushioning layer with Sumitomo 3M (Ltd) double-sided adhesive tape 442J (double-sided adhesive tape in which the substrate is polyester film; tensile modulus=200 MPa). Using a silica-type polishing agent, the evaluation of the oxide film removal rate was carried out under evaluation conditions C at a platen rotation rate of 36 rpm. The average oxide film removal rate within 5 mm of the wafer edge was 1110 Å/minute and the uniformity 20, and the average oxide film removal rate within 3 mm of the wafer edge was 1130 Å/minute and the uniformity 25. Furthermore, when evaluation conditions D were used at a platen rotation rate of 46 rpm, the average oxide film removal rate within 5 mm of the wafer edge was 1340 Å/minute and the uniformity 21, while the average oxide film removal rate within 3 mm of the wafer edge was 1360 Å/minute and the uniformity 24. Thus the uniformity was poor. When an evaluation was carried out of the global step height under evaluation conditions A at a platen rotation rate of 36 rpm for a polishing time of 2 minutes, the global step height between the 40 μm width and the 400 μm width interconnect regions of the global step height evaluation test wafer was 0.06 μm. Again, when global step height was evaluated under evaluation conditions B at a platen rotation rate of 46 rpm for a polishing time of 1 minute 45 seconds, the global step height between the 40 μm width and 400 μm width interconnect regions of the global step height evaluation test wafer was 0.04 μm.

TABLE 1

| | Polishing Pad Construction | | | | Polishing Characteristics | | | | | |
|---|---|---|---|---|---|---|---|---|---|---|
| | Rubber A-type Micro-Hardness of Polishing Layer | Cushioning Layer Bulk Modulus (MPa) | Cushioning Layer Tensile Modulus (MPa) | Tensile Modulus of Intermediate Layer (MPa) | Uniformity Evaluation Conditions C within 5 mm of edge | Uniformity Evaluation Conditions C within 3 mm of edge | Uniformity Evaluation Conditions D within 5 mm of edge | Uniformity Evaluation Conditions D within 3 mm of edge | Global Step Height (μm) Evaluation Conditions A | Global Step Height (μm) Evaluation Conditions B |
| Example 1 | 98 | 140 | 4.5 | ≦0.1 | 8 | 10 | 7 | 11 | 0.04 | 0.01 |
| Example 2 | 98 | 100 | 10 | ≦0.1 | 7 | 10 | 9 | 11 | 0.04 | 0.02 |
| Example 3 | 98 | 100 | 12 | 10 | 6 | 10 | 9 | 11 | 0.06 | 0.04 |
| Example 4 | 98 | 80 | 10 | ≦0.1 | 8 | 10 | 10 | 12 | 0.04 | 0.01 |
| Example 5 | 98 | 50 | 11 | ≦0.1 | 7 | 11 | 11 | 14 | 0.04 | 0.01 |
| Example 6 | 98 | 100 | 19 | ≦0.01 | 6 | 10 | 10 | 12 | 0.04 | 0.01 |
| Example 7 | 98 | 110 | 16 | ≦0.1 | 7 | 11 | 12 | 14 | 0.04 | 0.01 |
| Example 8 | 98 | 120 | 0.7 | ≦0.1 | 7 | 11 | 9 | 12 | 0.04 | 0.01 |
| Comp. Ex. 1 | 98 | 3 | 50 | 200 | 10 | 17 | 17 | 20 | 0.06 | 0.04 |
| Comp. Ex. 2 | 75 | 3 | 50 | 200 | 6 | 7 | 6 | 8 | 0.15 | 0.10 |
| Comp. Ex. 3 | 98 | 600 | 100 | 10 | 20 | 25 | 21 | 23 | 0.06 | 0.04 |
| Comp. Ex. 4 | 98 | 100 | 12 | 200 | 20 | 25 | 21 | 24 | 0.06 | 0.04 |

What is claimed is:

1. A polishing pad which is characterized in that it has a polishing layer of rubber A-type microhardness of at least 80° and a cushioning layer of bulk modulus at least 40 MPa and tensile modulus in the range 0.1 MPa to 20 MPa.

2. A polishing pad according to claim 1 which is characterized in that the bulk modulus of the cushioning layer is at least 60 MPa.

3. A polishing pad according to claim 2 which is characterized in that the bulk modulus of the cushioning layer is at least 90 MPa.

4. A polishing pad according to claim 1 which is characterized in that the tensile modulus of the cushioning layer is in the range 0.5 MPa to 18 MPa.

5. A polishing pad according to claim 4 which is characterized in that the tensile modulus of the cushioning layer is in the range 5 MPa to 15 MPa.

6. A polishing pad according to claim 1 which is characterized in that the thickness of the cushioning layer is in the range 0.1 to 100 mm.

7. A polishing pad according to claim 6 which is characterized in that the thickness of the cushioning layer is in the range 0.2 to 5 mm.

8. A polishing pad according to claim 1 which is characterized in that the chief component of the polishing layer is polyurethane and, furthermore, the density is in the range 0.70 to 0.90.

9. A polishing pad according to claim 1 which is characterized in that the polishing layer contains polyurethane and polymer from the polymerization of a vinyl compound and the proportion of polymer from the polymerization of a vinyl compound is 50–90 wt %, and it possesses closed cells of average cell diameter no more than 1000 μm and, furthermore, the density is in the range 0.4 to 1.1.

10. A polishing pad according to claim 1 which is characterized in that the tensile modulus of an intermediate layer between the polishing layer and the cushioning layer is no more than 20 MPa.

11. A method of polishing a semiconductor substrate which is characterized in that the semiconductor substrate is fixed to a polishing head and, with a polishing pad according to claim 1 fixed to a polishing platen in a state such that the polishing layer is pressed against the semiconductor substrate, said semiconductor substrate is polished by rotation of the aforesaid polishing head or polishing platen, or both.

12. A polishing method according to claim 11 which is 30 characterized in that the polishing pad is a polishing pad according to claim 9.

13. A polishing device which is characterized in that it is a polishing device equipped with a polishing head, a polishing pad confronting the polishing head, a polishing platen to which the polishing pad is fixed, and a means for rotating the polishing head, the polishing platen or both of these, and where the polishing pad is the polishing pad according to claim 1, the polishing layer of which is fixed and faces the polishing head.

14. A polishing device according to claim 13 where the polishing head has a means for fixing the semiconductor substrate.

* * * * *